US007175446B2

(12) United States Patent
Bright et al.

(10) Patent No.: US 7,175,446 B2
(45) Date of Patent: Feb. 13, 2007

(54) ELECTRICAL CONNECTOR

(75) Inventors: Edward John Bright, Middletown, PA (US); Michael Fogg, Harrisburg, PA (US); Douglas Glover, Dauphin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/091,235

(22) Filed: Mar. 28, 2005

(65) Prior Publication Data

US 2006/0216969 A1 Sep. 28, 2006

(51) Int. Cl.
*H01R 12/00* (2006.01)

(52) U.S. Cl. ..... 439/79

(58) Field of Classification Search ..... 439/79, 439/607–610, 78, 80, 941, 67, 650, 76.1
See application file for complete search history.

(56) References Cited

U.S. PATENT DOCUMENTS

| | | | | |
|---|---|---|---|---|
| 6,379,188 | B1 | 4/2002 | Cohen et al. | |
| 6,793,536 | B2 | 9/2004 | Takeyama et al. | |
| 6,824,391 | B2 | 11/2004 | Mickievicz et al. | |
| 6,884,117 | B2 * | 4/2005 | Korsunsky et al. | 439/607 |
| 6,890,214 | B2 * | 5/2005 | Brown et al. | 439/608 |
| 2003/0219999 | A1 * | 11/2003 | Minich et al. | 439/79 |

* cited by examiner

*Primary Examiner*—J. F. Duverne

(57) ABSTRACT

An electrical connector includes a dielectric housing that holds pairs of signal modules adjacent one another. Each signal module includes a mating edge having a row of mating contacts, a mounting edge having a row of mounting contacts, and a plurality of conductors electrically connecting each mating contact with a respective mounting contact. The mating contacts in adjacent modules have a first contact spacing therebetween, and the mounting contacts in adjacent modules have a second spacing therebetween. The conductors in adjacent modules have a third spacing therebetween. The second and third spacings are selected to provide a pre-determined impedance through the signal modules.

19 Claims, 7 Drawing Sheets

ELECTRICAL CONNECTOR

BACKGROUND OF THE INVENTION

The invention relates generally to electrical connectors and, more particularly, to a board-to-board connector for transmitting differential signals.

With the ongoing trend toward smaller, faster, and higher performance electrical components, it has become increasingly important for the electrical interfaces along the electrical paths to also operate at higher frequencies and at higher densities with increased throughput.

In a traditional approach for interconnecting circuit boards, one circuit board serves as a back plane and the other as a daughter board or main board. Rather than directly connecting the circuit boards, the back plane typically has a connector, commonly referred to as a header, that includes a plurality of signal pins or contacts which connect to conductive traces on the back plane. The daughter board connector, commonly referred to as a receptacle, also includes a plurality of contacts or pins. When the header and receptacle are mated, signals can be routed between the two circuit boards. In contrast, some electronic devices, such as pluggable transceivers, cable assemblies, and pluggable mezzanine cards, are designed to operate with connections made directly to a circuit board.

The migration of electrical communications to higher data rates has resulted in more stringent requirements for density and throughput while maintaining signal integrity. In addition to density and throughput requirements, there is also a requirement to minimize the size and reduce the complexity of the electrical interfaces.

At least some board-to-board connectors are differential connectors wherein each signal requires two lines that are referred to as a differential pair. For better performance, a ground may be associated with each differential pair. The connector typically includes a number of modules having contact edges that are at right angles to each other.

In one known connector, flat flexible cables are used to interconnect plug-in card slots to a circuit board or host board. Compression connections are used to make the connection to the circuit board. With this design, the user has to line up the flexible cable with a stiffener underneath, and fasten the cable with the compression fitting. The process requires some amount of precision and can be quite tedious.

As the transmission frequencies of signals through these connectors increase, it becomes increasingly important to maintain a desired impedance through the connector to minimize signal degradation. In addition, a ground shield is sometimes provided on the module to reduce interference or crosstalk. Improving connector performance and increasing contact density to increase signal carrying capacity without increasing the size of the connectors remains a challenge.

BRIEF DESCRIPTION OF THE INVENTION

In one aspect, an electrical connector is provided that includes a dielectric housing that holds pairs of signal modules adjacent one another. Each signal module includes a mating edge having a row of mating contacts, a mounting edge having a row of mounting contacts, and a plurality of conductors electrically connecting each mating contact with a respective mounting contact. The mating contacts in adjacent modules have a first contact spacing therebetween, and the mounting contacts in adjacent modules have a second spacing therebetween. The conductors in adjacent modules have a third spacing therebetween. The second and third spacings are selected to provide a pre-determined impedance through the signal modules.

Optionally, the connector further includes a plurality of ground modules arranged in a pattern with the signal modules, wherein the pattern includes pairs of signal modules and individual ground modules arranged in an alternating sequence. Each signal module includes an over-molded signal lead frame while each ground module is a solid conductive lead frame. Adjacent signal modules comprise differential pairs. The mounting contacts of the differential pairs are offset in opposite directions from a center position in the signal modules.

In another aspect, an electrical connector is provided that includes a dielectric housing that holds pairs of signal modules adjacent one another. Each signal module includes a mating edge having a row of mating contacts, a mounting edge having a row of mounting contacts, and a plurality of conductors electrically connecting each mating contact with a respective mounting contact. The pairs of signal modules include long lead frame pairs and short lead frame pairs arranged in an alternating sequence.

In yet another aspect, an electrical connector is provided that includes a dielectric housing having a mating face and a mounting face. The mating face includes a slot configured to receive an edge of a circuit board. The mounting face is configured for press fit termination to a host board. Pairs of signal modules are held adjacent one another in the housing. Each signal module includes a mating edge having a row of mating contacts proximate the mating face and a mounting edge having a row of mounting contacts proximate the mounting face. A plurality of conductors electrically connect each mating contact with a respective mounting contact. The mating contacts in adjacent modules have a first contact spacing therebetween. The mounting contacts in adjacent modules have a second spacing therebetween, and the conductors in adjacent modules have a third spacing therebetween. The second and third spacings are selected to provide a pre-determined impedance through the signal modules.

DETAILED DESCRIPTION OF THE INVENTION

Figure 1:
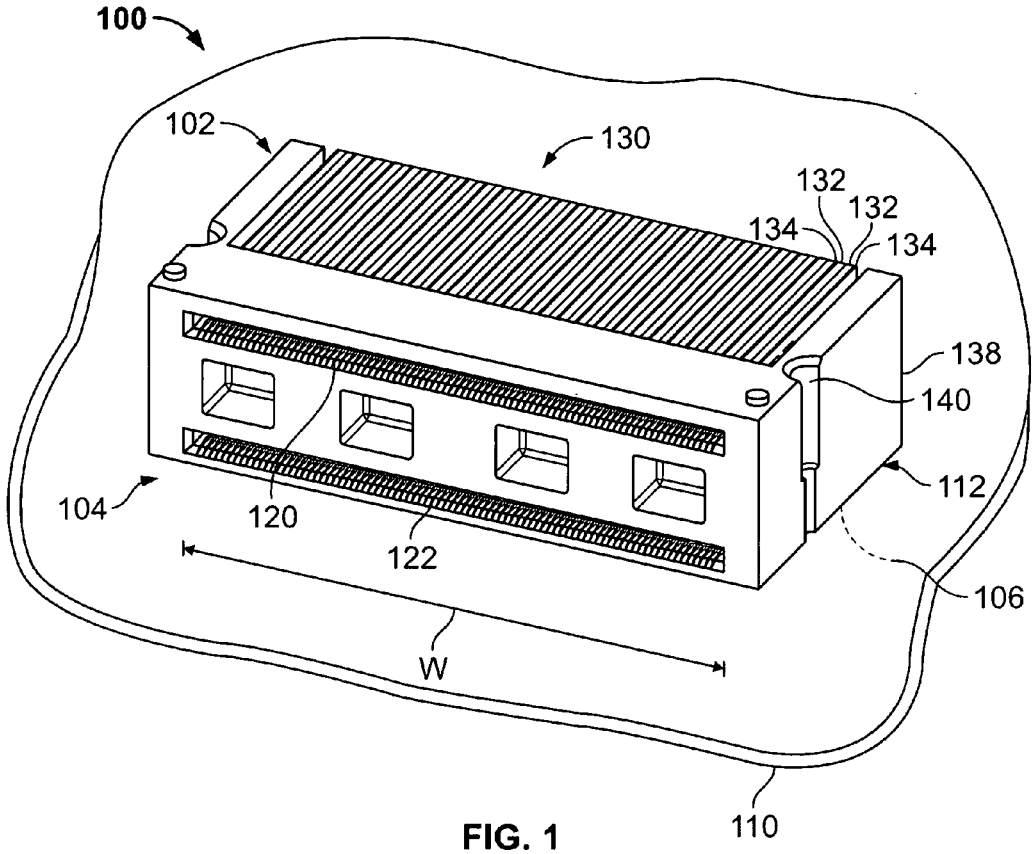
FIG. 1 is a perspective view of an electrical connector formed in accordance with an exemplary embodiment of the present invention.

FIG. 1 illustrates an electrical connector 100 formed in accordance with an exemplary embodiment of the present invention. The connector 100 includes a dielectric housing 102 having a forward mating face 104 and a mounting face 106. The connector 100 is mounted on a circuit board 110, that is sometimes referred to as a host board 110, at a mounting interface 112 at the host board 110. The connector 100 is configured to receive card type pluggable modules or circuit boards (not shown in FIG. 1) in upper and lower slots 120 and 122, respectively, at the mating face 104 of the connector 100. The plug in modules are connected to the host board 110 through the connector 100. The plug in modules may influence such parameters as the overall width of the slots 120 and 122 and a contact spacing at the mating face 104 of the connector 100. While the connector 100 will be described with particular reference to an Advanced Telecom Computing Architecture (ATCA) mezzanine card (AMC) connector, it is to be understood that the benefits herein described are also applicable to other connectors that are designed to adhere to other standards, such as, for example, Peripheral Component Interconnect (PCI) express, and 10 Gbps Small Form Factor Pluggable (XFP) modules, and the like. The following description is therefore provided for purposes of illustration, rather than limitation, and is but one potential application of the inventive concepts herein.

The connector 100 includes a plurality of contact modules 130 that includes signal modules 132 and ground modules 134 that are loaded into the housing 102. The signal and ground modules 132 and 134, respectively, are arranged in a repeating and alternating ground-signal-signal-ground pattern wherein two signal modules 132 are adjacent one another and sandwiched between individual ground modules 134. The adjacent signal modules 132 form a differential pair carrying differential signals. In one embodiment, the connector mounting face 106 is substantially flat and the signal and ground contact modules 132 and 134, respectively, are provided with compliant eye of the needle type contacts 174 (FIG. 2) proximate the mounting face 106 to facilitate press-fit termination of the connector 100 to the host board 110. The flat mounting face 106 is compatible with A and B style conventional carrier boards. The housing 102 includes side panels 138 that, in one embodiment, include holes 140 for component cover mounting screws when multiple connectors 100 are positioned side by side.

Figure 2:
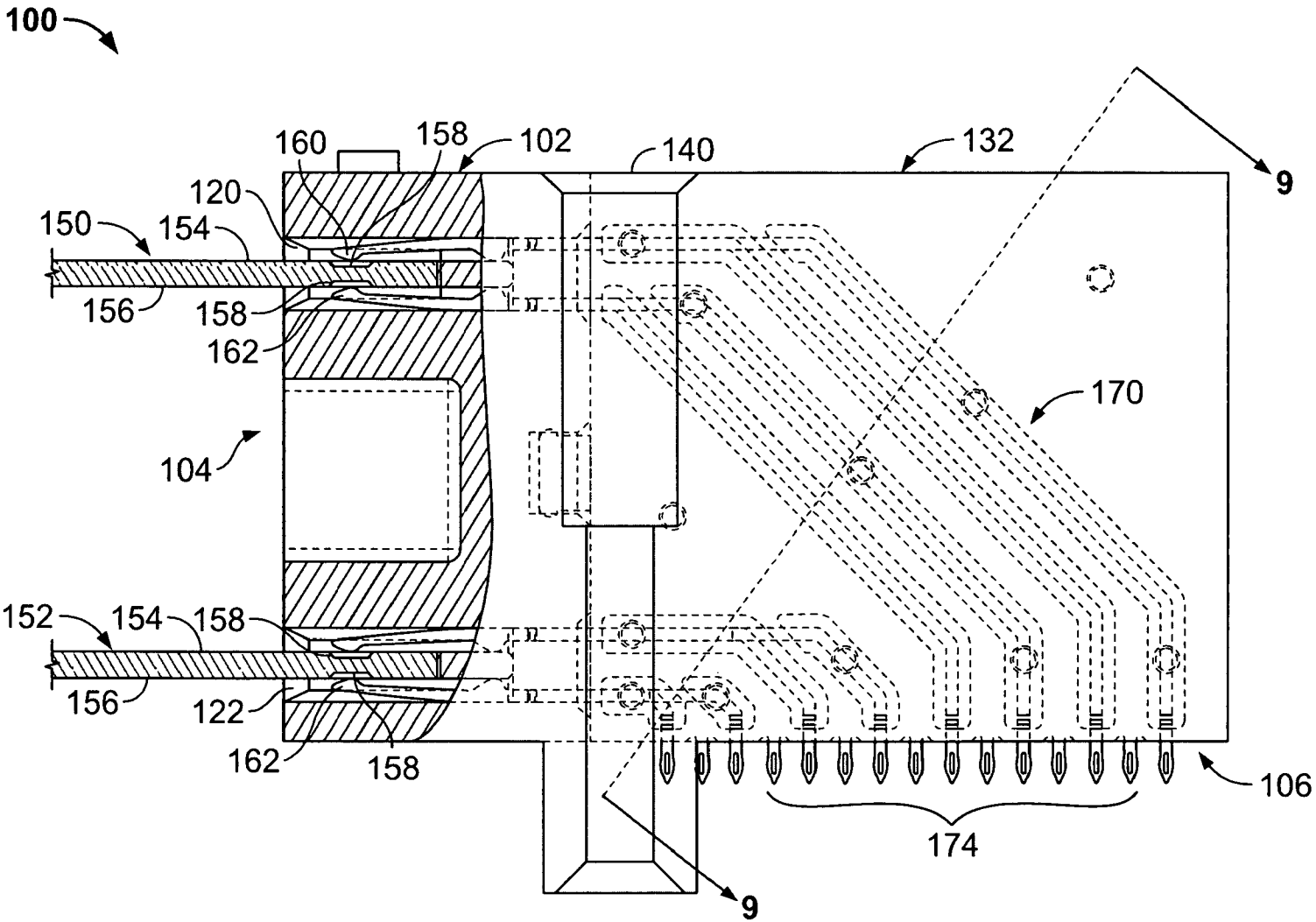
FIG. 2 is a side view of the connector shown in FIG. 1 and partially cut away.

FIG. 2 is a side view of the connector 100. In FIG. 2, the mating face 104 of the housing 102 is partially cut away. A first mating circuit board 150 is received in the upper slot 120 and a second mating circuit board 152 is received in the lower slot 122. Each mating circuit board 150 and 152 includes an upper surface 154 and a lower surface 156, each of which includes a plurality of contact pads 158. Each signal module 132 and each ground module 134 includes upper spring contacts 160 and lower spring contacts 162 arranged in pairs and aligned with one of the upper and lower slots 120 and 122 proximate the mating face 104 of the housing 102. The upper spring contacts 160 engage the contact pads 158 on the upper surfaces 154 of the mating circuit boards 150 and 152 while the lower spring contacts 162 separately engage the contact pads on the lower surfaces 156 of the mating circuit boards 150 and 152. Adjacent upper spring contacts 160 in adjacent signal modules 132 form differential contact pairs, and similarly, adjacent lower spring contacts 162 in adjacent signal modules 132 also form differential contact pairs. Each of the spring contacts 160 and 162 is terminated to the host board 110 via one of a plurality of leads 170 (shown in phantom in FIG. 2) to a mounting contact 174 that is terminated to the host board 110. In an exemplary embodiment, the signal modules 132 comprise two different types, long and short, or more specifically, long lead frame and short lead frame as described below.

Figure 3:
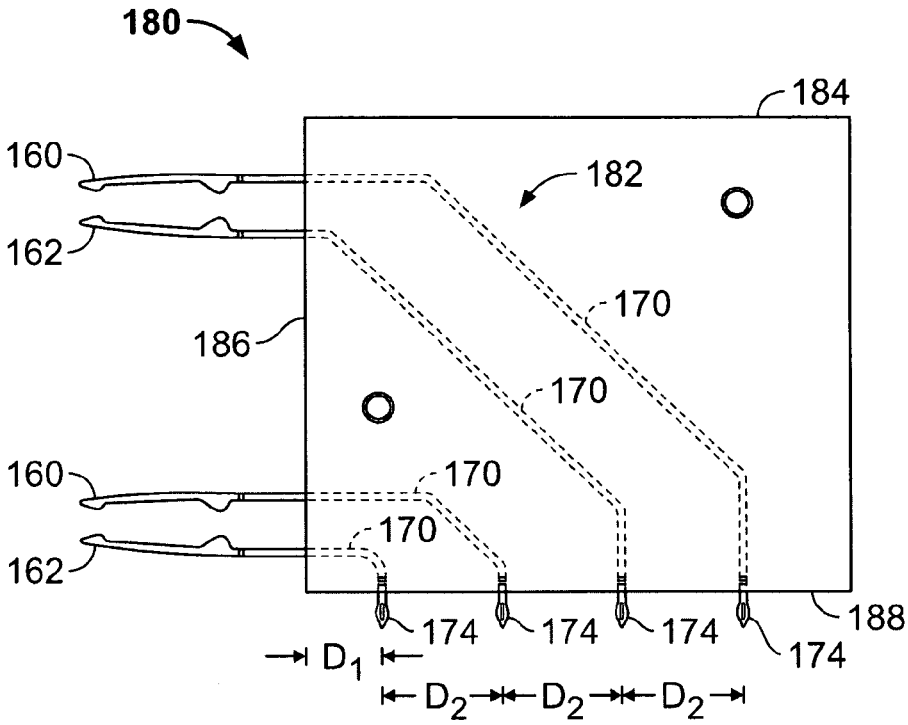
FIG. 3 is a side view of a short signal module formed in accordance with an exemplary embodiment of the present invention.

FIG. 3 is a side view of a short signal module 180. The signal module 180 includes a lead frame 182 that has upper and lower spring contacts 160 and 162, that are each electrically connected to a respective mounting contact 174 with a lead 170. The lead frame 182 is over-molded in a housing 184 that has a forward mating edge 186 and a mounting edge 188. In one embodiment, the mating edge, 186 and the mounting edge 188 are substantially perpendicular to one another. The spring contacts 160 and 162 are arranged along the mating edge 186. The mounting contacts 174 are arranged along the mounting edge 188. The forward most mounting contact 174 is offset a distance $D_1$ from the forward mating edge 186 of the housing 184. The mounting contacts 174 have a substantially equal spacing between contacts of $D_2$.

Figure 4:
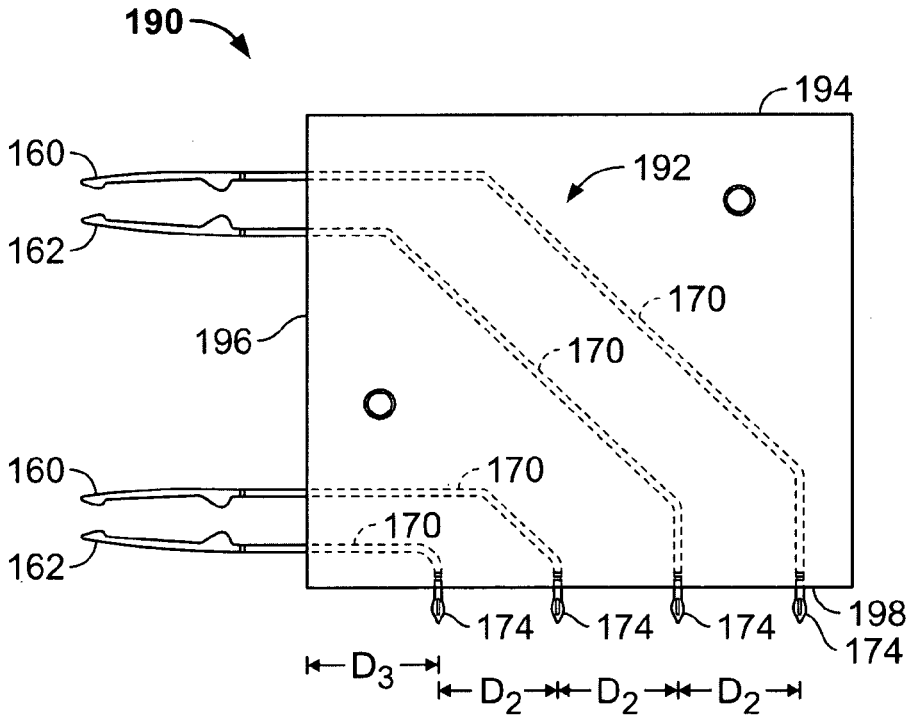
FIG. 4 is a side view of a long signal module formed in accordance with an exemplary embodiment of the present invention.

FIG. 4 is a side view of a long signal module 190. The signal module 190 includes a lead frame 192 that has upper and lower spring contacts 160 and 162, that are each electrically connected to a mounting contact 174 with a lead 170. The lead frame 192 has an over-molded housing 194 that has a forward mating edge 196 and a mounting edge 198. The mating edge 196 and the mounting edge 198 are, in one embodiment, substantially perpendicular to one another. The spring contacts 160 and 162 are arranged along the mating edge 196. The mounting contacts 174 are arranged along the mounting edge 198. The long signal module 190 differs from the short signal module 180 (FIG. 3) in the placement of the mounting contacts 174 along the mounting edge 198. In the case of the long signal module 190, the forward most mounting contact 174 is offset a distance $D_3$ from the forward mating edge 196 of the housing 194. The offset distance $D_3$ is greater than the offset distance $D_1$. The offset distances $D_1$ and $D_3$ characterize the signal modules as either long or short, with $D_1$ being characterized as short and $D_3$ as long. After the offset, the mounting contacts 174 on the long signal module 190 have the same spacing $D_2$ as the short signal module 180. In this discussion, the terms long and short signal modules and long and short lead frame modules have similar meanings and are used interchangeably.

The short signal modules 180 and long signal modules 190 are used in pairs adjacent one another in the connector 100. The short and long signal modules 180 and 190, respectively, cooperate to separate or displace adjacent differential pairs from one another such that crosstalk between the adjacent differential pairs is reduced. In addition, because a differential pair is comprised of contacts and leads that are side by side in adjacent identical modules, the electrical path lengths of the differential pair are substantially the same so that skew in the differential pairs is virtually eliminated.

Figure 5:
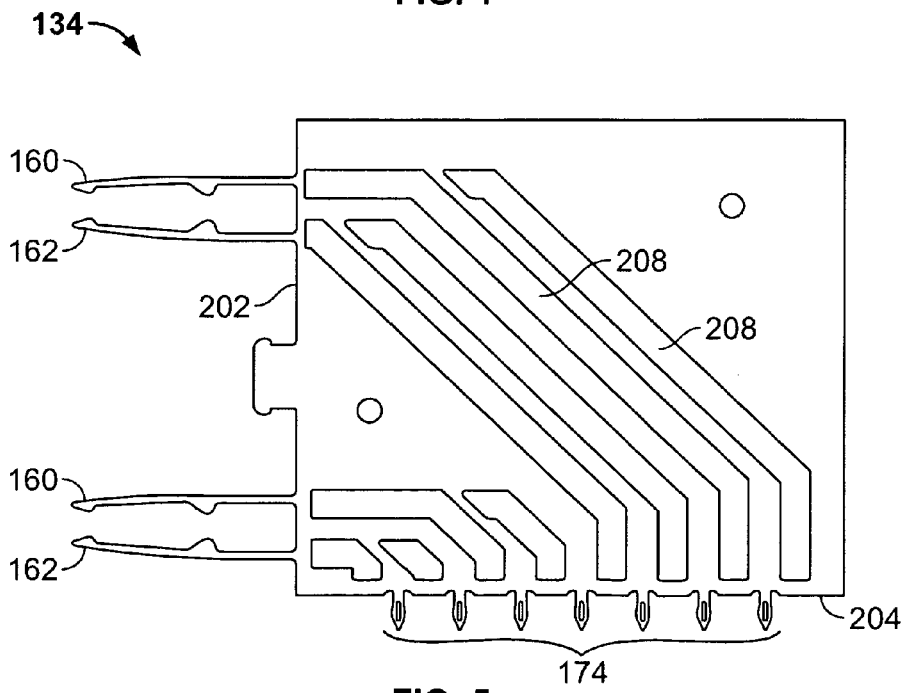
FIG. 5 is a side view of a ground module formed in accordance with an exemplary embodiment of the present invention.

FIG. 5 is a side view of a ground module 134. Unlike the short and long signal modules 180 and 190, the ground module 134 is a solid conductive lead frame that is not over-molded. In an exemplary embodiment, the ground module 134 is fabricated from a conductive metal. The ground module 134 has a forward mating edge 202 from which upper and lower spring contacts 160 and 162, respectively, extend. A plurality of mounting edge contacts 174, are formed on a mounting edge 204. Rather than leads, slots 208 are formed in the ground module 134. In an exemplary embodiment, the ground module 134 is provided in only one configuration that is slotted for use with either the short or long signal modules 180, 190, respectively, described above. The ground module 134 also includes mounting edge contacts 174 positioned to provide shielding for the mounting edge contacts 174 of both the short and long signal modules 180 and 190, respectively.

Figure 6:
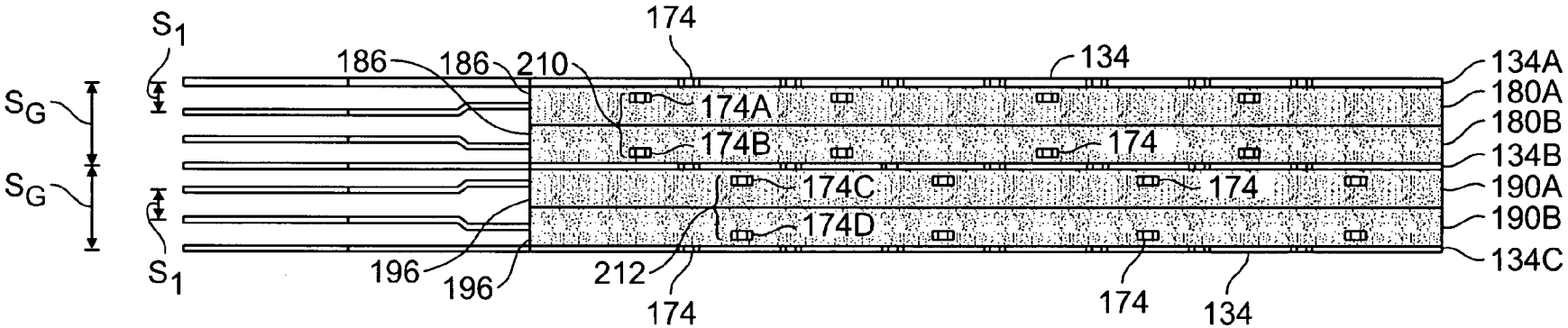
FIG. 6 is a bottom view of an assembly of long and short signal modules and ground modules.

FIG. 6 is a bottom view of an assembly of long and short signal modules 190 and 180, respectively with ground modules 134 as they would be arranged in the housing 102 (FIG. 2). FIG. 6 illustrates a contact pattern that coincides with a mounting contact pattern on the host board 110 (see FIG. 8), as well as the pattern in which the signal modules 180, 190 and the ground modules 134 are arranged. In general, the modules are arranged in a ground-signal-signal, ground-signal-signal pattern. From top to bottom in FIG. 6, there is the ground module 134A, followed by two signal modules 180A and 180B, followed by the ground module 134B, followed by two signal modules 190A and 190B, and ending with the ground module 134C, thus illustrating the ground-signal-signal pattern.

In an exemplary embodiment, the module arrangement further includes pairs of short and long signal modules 180 and 190, respectively, arranged in an alternating sequence as results when the pattern shown in FIG. 6 is repeated. Adjacent contacts, such as the contacts 174A and 174B in the adjacent short signal modules 180A and 180B form a differential pair 210. Similarly, the adjacent contacts 174C and 174D in the adjacent long signal modules 190A and 190B also form a differential pair 212. With the short and long signal module configurations, adjacent differential pairs 210 and 212 are displaced from one another to reduce cross talk between the differential pairs 210 and 212. In addition, the interspersing of the ground modules 134 between pairs of signal modules further shields the differential pairs 210 and 212 to further reduce cross talk.

The spring contacts 160 and 162 have a uniform spacing $S_1$ between adjacent spring contacts 160 and 162 across the width W of the slots 120 and 122 (FIG. 1). The spacing $S_1$ is established to match the contact spacing on the mating circuit boards 150 and 152 (FIG. 2). In some embodiments, the spring contact spacing $S_1$ is established to conform to an industry standard. For instance, in one embodiment, the spacing $S_1$ is set to 0.75 millimeters which corresponds to an AMC connector standard. Every third spring contact 160 and 162 is associated with a ground module 134. Thus, there is a spacing $S_G$ between the spring contacts 160 and 162 on the ground modules 134 that is three times the spacing $S_1$.

Figure 7:
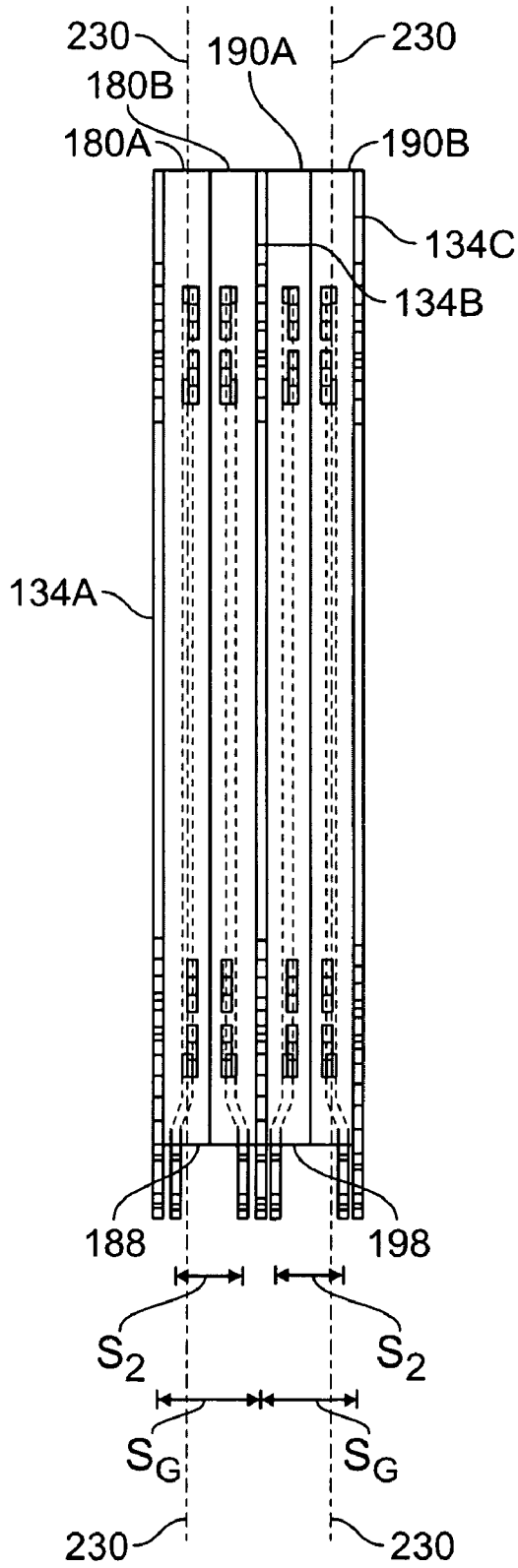
FIG. 7 is a front view of an assembly of long and short signal modules with left hand and right hand pairs.

FIG. 7 illustrates the contact module assembly shown in FIG. 6 viewed from the mating edges 186 and 196 of the short and long signal modules 180 and 190, respectively. Within the short and long signal module types, 180 and 190, respectively, the signal modules 180 and 190 are further divided into a left hand signal module and a right hand signal module. In FIGS. 6 and 7, the short signal module 180A is also a left hand signal module while the short signal module 180B is also a right hand signal module. Similarly, the long signal module 190A is also a left hand signal module while the long signal module 190B is also a right hand signal module.

The left and right hand designations identify the location of the mounting contacts 174 at the mounting edges 188 and 198 of the signal modules 180 and 190, respectively, as being offset either to the left or the right of a centerline 230 of the over molded housings 184 and 194 of the signal modules 180 and 190. In one embodiment, the mounting contacts 174 are stepped contacts that provide left and right offsets. The displacement of the mounting contacts 174 at the mounting edges 188 and 198 of the signal modules 180 and 190, respectively, allows for a contact spacing for the mounting contacts to be established that is different from the spacing of the spring contacts at the mating edge of the signal modules 180 and 190. In the embodiment shown in FIG. 7, the spread of the mounting contacts 174 of the short signal module pair 180A and 180B and the long signal module pair 190A and 190B to produces a spacing $S_2$ for the signal module mounting that is different from the spacing $S_1$ of the spring contacts 160 and 162. Each differential pair of signal contact modules 180 and 190 is comprised of a left hand module and a right hand module. Further, the mounting contacts 174 in each differential pair are stepped contacts that are offset in opposite directions from the centerline 230 of their respective signal modules 180 and 190.

Figure 8:
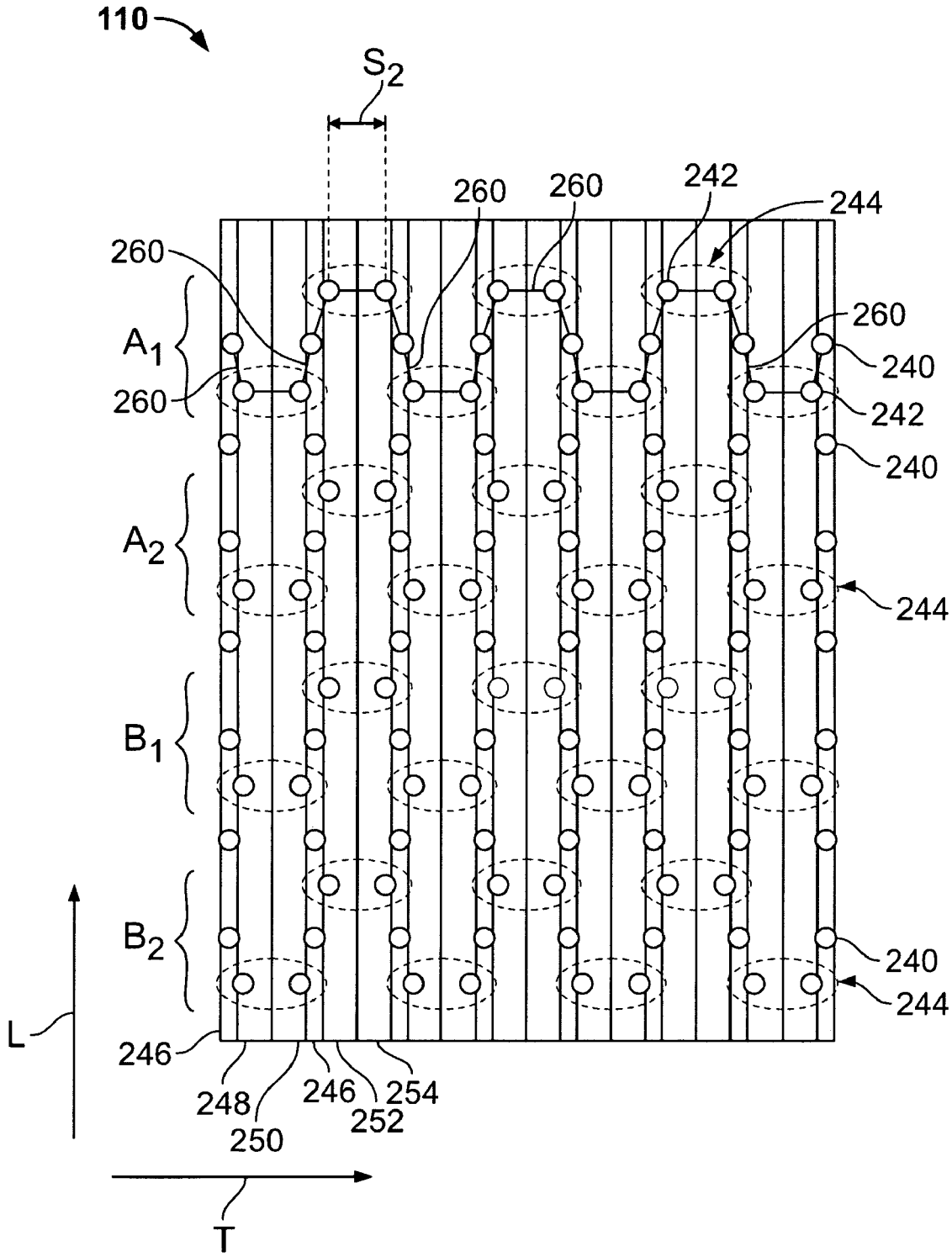
FIG. 8 is a top plan view illustrating the mounting hole layout of an exemplary host board.

FIG. 8 is a top plan view illustrating an exemplary mounting hole layout in the host board 110. The mounting hole layout includes a plurality of ground contact apertures 240, which, for identification purposes, are shown shaded in FIG. 8, and a plurality of signal contact apertures 242. Differential pairs 244 of signal contact apertures 242 are shown encircled together. The spacing of the mounting contacts 174 at the host board 110 is determined by the aperture spacing on the host board 110. The spacing and size of the apertures are selected to provide a predetermined impedance through the apertures and permit routing of traces to the apertures. In an exemplary embodiment, the contact apertures 240 and 242 have a diameter of 0.46 millimeters and the spacing $S_2$ between adjacent signal module contacts is 1.5 millimeters. The predetermined impedance is one hundred ohms.

The mounting hole layout on the host board 110 reflects the arrangement of ground modules 134 and signal modules 180, 190 in the housing 102 (FIG. 1). More specifically, the ground modules 134 and signal modules 180, 190 are oriented longitudinally in a direction parallel to the arrow L and are arranged transversely along the slots 120 and 122 (FIG. 1) in the direction of the arrow T when the connector 100 is terminated to the host board 110. When so arranged, the apertures of the host board 110 are aligned in rows extending parallel to the arrow L to receive respective contacts of the ground modules 134 and the signal modules 180, 190. Specifically, and as shown in FIG. 8, the contact aperture rows 246 receive mounting contacts 174 from the ground modules 134. The contact aperture rows 248 receive mounting contacts 174 from a left hand long signal module 190A (FIG. 7), while the contact aperture rows 250 receives mounting contacts 174 from a right hand long signal module 190B (FIG. 7). Similarly, the contact aperture rows 252 receive mounting contacts 174 from a left hand short signal module 180A (FIG. 7), while the contact aperture rows 254 receive mounting contacts 174 from a right hand short signal module 180B (FIG. 7). As shown, the differential pairs 244 are apertures that receive mounting contacts 174 from adjacent left and right hand combinations of short and long signal modules 180 and 190, respectively.

The mounting hole layout on the host board also reflects the ground and signal routing from the slots 120 and 122 transversely across the width W of the slots 120 and 122 with corresponding host board apertures extending along the host board 110 in the direction of the arrow T. For instance, the transverse aperture group labeled $A_1$ represents apertures that receive terminating connections taken from the lower surface 156 of the mating board 152 at the lower slot 122 from the mating face 104 (FIG. 2) of the housing 102 (FIG.

2). The group $A_2$ represents apertures that receive terminating connections taken from the upper surface 154 of the mating board 152. Similarly, the transverse aperture group $B_1$ represents apertures that receive terminating connections taken from the lower surface 156 of the mating board 150 at the upper slot 120 from the mating face 104 (FIG. 2). The group $B_2$ represents apertures that receive terminating connections taken from the upper surface 154 of the mating board 150 at the upper slot 120. With reference to the group $A_1$, the sequential terminating connections are shown with the broken line 260 and illustrates the repeating ground-signal-signal pattern of the ground modules 134 and signal modules 132 in the housing 102 (FIG. 1). The signal contact apertures 242 in the differential pairs 244 are isolated by surrounding ground contact apertures 240 and are also sufficiently distanced from adjacent signal contact apertures 242 so that crosstalk at the host board to connector interface 112 is minimized.

Figure 9:
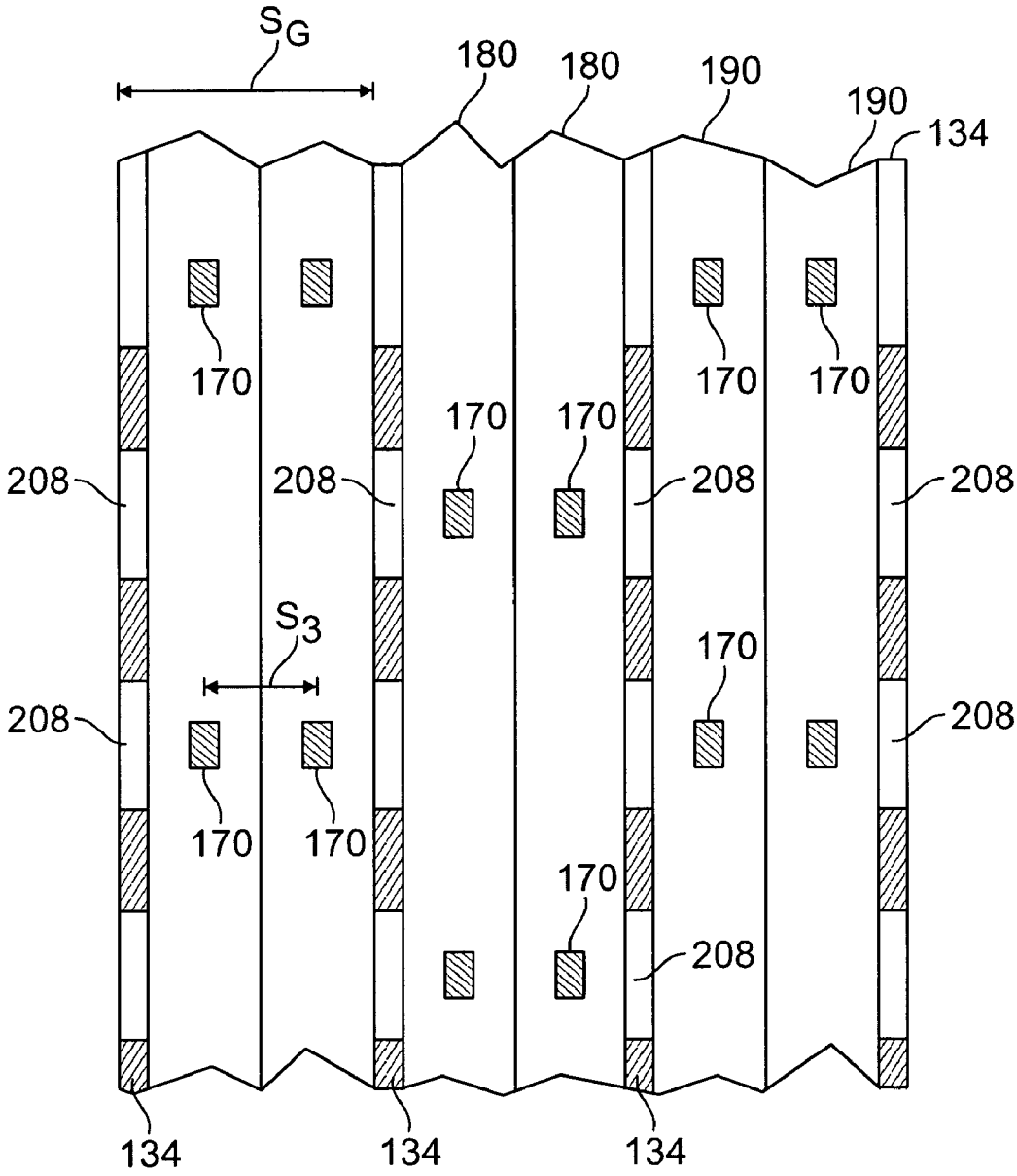
FIG. 9 is a partial cross sectional view of the connector 100 taken along the line 9—9 in FIG. 2.

FIG. 9 is a partial cross sectional view of the connector 100 taken along the line 9—9 in FIG. 2. FIG. 9 illustrates a cross section through a representative number of adjacent signal modules 180, 190 and ground modules 134. The ground-signal-signal module pattern is apparent in the cross section. As described above, the ground modules 134 are not over molded and have a spacing $S_G$ between adjacent ground modules 134 that is three times the contact spacing $S_1$ of the spring contacts 160, 162 (see FIG. 6) at the mating face 104 (FIG. 1). The spacing $S_1$ may be different from the mounting contact spacing $S_2$ of the mounting contacts 174 of the signal modules 180 and 190 at the mounting interface 112 at the host board 110 (FIG. 8). The spacing $S_1$ may be a spacing that is established to conform to an industry standard. The spacing $S_2$, on the other hand, is influenced by the host board layout, contact aperture dimensions, and other circuit board design issues. Thus, a transition takes place within the signal modules 180 and 190 from the spring contact spacing $S_1$ at the mating face 104 of the housing 102 to the mounting contact spacing $S_2$ at the mounting interface 112.

A third spacing $S_3$ is established as a transition centerline spacing between the leads 170 of a differential pair within the signal modules 180 and 190. The connector 100 is configured to have a predetermined characteristic impedance that is maintained to minimize signal loss in the connector 100. The spacing $S_3$ is selected to maintain the predetermined characteristic impedance through the signal modules 180 and 190. The impedance in the signal modules 180 and 190 can be analytically determined using known techniques that include, among other factors, the dielectric properties of the signal module over mold material, the pattern of the slots 208 in the ground modules 134, and the size and cross section of the signal leads 170, together with the spacing $S_3$ between the signal leads 170. In an exemplary embodiment, the spring contact spacing $S_1$ is set at 0.75 millimeters and conforms to an AMC standard, while the mounting contact spacing $S_2$ is set at 1.5 millimeters at the host board interface 112. In this embodiment, the transition spacing $S_3$ is set at 1.02 millimeters to provide a predetermined impedance of one hundred ohms through the signal modules 180 and 190, which also conforms to an AMC standard.

The embodiments herein described provide an electrical connector 100 that interconnects a circuit board 150, 152 in a pluggable module to a host board 110. The connector has low noise characteristics while carrying multiple differential data pairs. A predetermined impedance is maintained through the connector to minimizing signal loss. Ground modules 134 are arranged with long lead frame and short lead frame signal modules 190 and 180, respectively, in a pattern whereby the differential signal pair are surrounded by grounds that provide isolation, and are sufficiently distanced from other differential signal pairs to minimize crosstalk. Contact spacing at the circuit board interface or connector mating face is at a first spacing $S_1$ that conforms to a specified industry standard. Contact spacing at the host board is at a second predetermined spacing $S_2$ that may be different from the first spacing. Lead spacing within the signal modules is at a third spacing $S_3$ selected to maintain the predetermined impedance so that signal loss is minimized.

While the invention has been described in terms of various specific embodiments, those skilled in the art will recognize that the invention can be practiced with modification within the spirit and scope of the claims.

What is claimed is:

1. An electrical connector comprising:

a dielectric housing;

pairs of signal modules held adjacent one another in said housing, each said signal module comprising:

a mating edge having a row of mating contacts;

a mounting edge having a row of mounting contacts; and a plurality of conductors electrically connecting each said mating contact with a respective mounting contact;

wherein said mating contacts in adjacent modules have a first contact spacing therebetween, said mounting contacts in adjacent modules have a second spacing therebetween, and said conductors in adjacent modules have a third spacing therebetween, and wherein said second and third spacings are selected to provide a pre-determined impedance through said signal modules.

2. The connector of claim 1, wherein the connector further comprises a plurality of ground modules arranged in a pattern with said signal modules, said pattern including pairs of signal modules and individual ground modules arranged in an alternating sequence.

3. The connector of claim 1, wherein the connector further comprises a plurality of ground modules arranged in a pattern with said signal modules, and wherein each said signal module includes an over-molded signal lead frame while each said ground module comprises a solid conductive lead frame.

4. The connector of claim 1, wherein adjacent signal modules comprise differential pairs, and wherein said mounting contacts of said differential pairs are stepped contacts that are offset in opposite directions from a centerline of said signal modules.

5. The connector of claim 1, wherein adjacent signal modules comprise differential pairs, wherein each said differential pair includes mating and mounting contacts located in separate adjacent signal modules.

6. The connector of claim 1, wherein adjacent signal modules comprise differential pairs, and wherein the conductors interconnecting said mating contacts and mounting contacts of each differential pair are substantially identical in length such that signal skew in said differential pairs is substantially eliminated.

7. An electrical connector comprising:

a dielectric housing;

pairs of signal modules held adjacent one another in said housing, each said signal module comprising:

a mating edge having a row of mating contacts;

a mounting edge having a row of mounting contacts; and a plurality of conductors electrically connecting each said mating contact with a respective mounting contact;

wherein said pairs of signal modules include long lead frame pairs and short lead frame pairs arranged in an alternating sequence, wherein said pairs of signal modules comprise differential pairs, and wherein said long lead frame signal modules and short lead frame signal modules cooperate to separate adjacent differential pairs to reduce crosstalk between said adjacent differential pairs.

8. The connector of claim 7, wherein the connector further comprises a plurality of ground modules wherein individual ground modules are interspersed between adjacent said pairs of signal modules.

9. An electrical connector comprising:

a dielectric housing;

pairs of signal modules held adjacent one another in said housing, each said signal module comprising:

a mating edge having a row of mating contacts;

a mounting edge having a row of mounting contacts; and a plurality of conductors electrically connecting each said mating contact with a respective mounting contact;

wherein said pairs of signal modules include long lead frame pairs and short lead frame pairs arranged in an alternating sequence, wherein said connector is an Advanced Telecom Computing Architecture mezzanine card (AMC) connector.

10. The connector of claim 7, wherein each pair of long lead frame signal modules forms a differential pair and each pair of short lead frame signal modules forms a differential pair.

11. An electrical connector comprising:

a dielectric housing;

pairs of signal modules held adjacent one another in said housing, each said signal module comprising:

a mating edge having a row of mating contacts;

a mounting edge having a row of mounting contacts; and a plurality of conductors electrical connecting each said mating contact with a respective mounting contact;

wherein said pairs of signal modules include long lead frame pairs and short lead frame pairs arranged in an alternating sequence, each pair of said long lead fine signal modules forms a differential pair and each pair of said short lead frame signal modules forms a differential pair, and wherein said mounting contacts of said differential pairs are stepped contacts that are offset in opposite directions from a centerline of said signal modules.

12. An electrical connector comprising:

a dielectric housing;

pairs of signal modules held adjacent one another in said housing, each said signal module comprising:

a mating edge having a row of mating contacts;

a mounting edge having a row of mounting contacts; and a plurality of conductors electrically connecting each said mating contact with a respective mounting contact;

wherein said pairs of signal modules include long lead frame pairs and short lead frame pairs arranged in an alternative sequence, wherein adjacent signal modules comprise differential pairs, and wherein the conductors interconnecting said mating contacts and mounting contacts of each differential pair are substantially identical in length such that signal skew in said differential pairs is substantially eliminated.

13. An electrical connector comprising:

a dielectric housing having a mating face and a mounting face, said mating face including a slot configured to receive an edge of a circuit board, said mounting face configured for press fit termination to a host board;

pairs of signal modules held adjacent one another in said housing, each said signal module comprising:

a mating edge having a row of mating contacts proximate said mating face;

a mounting edge having a row of mounting contacts proximate said mounting face; and a plurality of conductors electrically connecting each said mating contact with a respective mounting contact;

wherein said mating contacts in adjacent modules have a first contact spacing therebetween, said mounting contacts in adjacent modules have a second spacing therebetween, and said conductors in adjacent modules have a third spacing therebetween, and wherein said second and third spacings are selected to provide a pre-determined impedance through said signal modules.

14. The connector of claim 13, wherein the connector further comprises a plurality of ground modules arranged in a pattern with said signal modules, said pattern including pairs of signal modules and individual ground modules arranged in an alternating sequence.

15. The connector of claim 13, wherein said pairs of signal modules include long lead frame pairs and short lead frame pairs arranged in an alternating sequence.

16. The connector of claim 13, wherein said pairs of signal modules include long lead frame pairs and short lead frame pairs arranged in an alternating sequence, and wherein adjacent signal modules comprise differential pairs, and wherein said long lead frame signal modules and short lead frame signal modules cooperate to separate adjacent differential pairs to reduce crosstalk between said adjacent differential pairs.

17. The connector of claim 13, wherein adjacent signal modules comprise differential pairs, and wherein said mounting contacts of said differential pairs are stepped contacts that are offset in opposite directions from a centerline of said signal modules.

18. The connector of claim 13, wherein adjacent signal modules comprise differential pairs, wherein each said differential pair includes mating and mounting contacts located in separate adjacent signal modules.

19. The connector of claim 13, wherein adjacent signal modules comprise differential pairs, and wherein the conductors interconnecting said mating contacts and mounting contacts of each differential pair are substantially identical in length such that signal skew in said differential pairs is substantially eliminated.

* * * * *